US010869566B2

(12) United States Patent
Kassab Arabo

(10) Patent No.: US 10,869,566 B2
(45) Date of Patent: Dec. 22, 2020

(54) MINIATURIZED TRAVEL CUSHION HAVING INNER OPPOSING LEDGE CONFIGURATIONS FOR PROVIDING SPACING FOR A WEARER'S EARS ALONG WITH SECONDARY DIRECTED PRESSURE GENERATING PORTIONS FOR TREATMENT OF TRAPEZIUS BACK MUSCLES

(71) Applicant: Alivia Kassab Arabo, West Bloomfield, MI (US)

(72) Inventor: Alivia Kassab Arabo, West Bloomfield, MI (US)

( * ) Notice: Subject to any disclaimer, the term of this patent is extended or adjusted under 35 U.S.C. 154(b) by 79 days.

(21) Appl. No.: 16/037,594

(22) Filed: Jul. 17, 2018

(65) Prior Publication Data

US 2018/0325292 A1 Nov. 15, 2018

Related U.S. Application Data

(63) Continuation-in-part of application No. 15/376,092, filed on Dec. 12, 2016, now abandoned, which is a (Continued)

(51) Int. Cl.
*A47G 9/10* (2006.01)
*A47C 16/00* (2006.01)

(Continued)

(52) U.S. Cl.
CPC ..... *A47G 9/1081* (2013.01); *A47C 7/383* (2013.01); *A47C 16/00* (2013.01); *A47G 9/0223* (2013.01);

(Continued)

(58) Field of Classification Search
CPC ..... A47G 9/0223; A47G 9/066; A47G 9/064; A47G 9/1045; A47G 9/1072;

(Continued)

(56) References Cited

U.S. PATENT DOCUMENTS

D124,296 S 12/1940 Thompson
2,293,590 A 8/1942 Beehler (Continued)

*Primary Examiner* — David R Hare
(74) *Attorney, Agent, or Firm* — Dinsmore & Shohl LLP

(57) ABSTRACT

A contoured cushion including a body constructed of memory foam material and configured with a plurality of three dimensional contoured surfaces adapted to conform to the shape of a user's head, neck, and upper shoulders for providing support to the user when supported in an upright seated position. The contoured surfaces include each of a pair of main lateral projecting portions adapted for supporting the sides of the user's head and neck, an intermediate interior portion with a contoured recess upper surface extending between the lateral portions and further adapted to supporting the base of the user's head in communication with the neck, and a pair of secondary portions extending downwardly from the interior portion and adapted to supporting the trapezius shoulder muscles of the user. The main cushion portions each further include an inner opposing recess defined by a ledge which adapts to provide clearance for the user's ears and anything supported thereto including jewelry or in-ear headphone buds.

11 Claims, 16 Drawing Sheets

Related U.S. Application Data continuation-in-part of application No. 14/520,950, filed on Oct. 22, 2014, now abandoned.

(60) Provisional application No. 61/896,231, filed on Oct. 28, 2013.

(51) Int. Cl.
*A47G 9/02* (2006.01)
*A47G 9/06* (2006.01)
*A47C 7/38* (2006.01)

(52) U.S. Cl.
CPC ..... *A47G 9/064* (2013.01); *A47G 9/066* (2013.01); *A47G 9/1045* (2013.01); *A47G 2009/1018* (2013.01)

(58) Field of Classification Search
CPC ..... A47G 9/1081; A47G 2009/1018; A47C 16/00; A47C 7/383
See application file for complete search history.

(56) References Cited

U.S. PATENT DOCUMENTS

D191,513 S 10/1961 Kerr
3,148,389 A 9/1964 Lustig
3,312,987 A 4/1967 Emery
3,835,471 A 9/1974 Lankford
3,863,283 A 2/1975 Mohr
3,879,775 A 4/1975 Iwata
3,958,274 A 5/1976 Klauber
D241,700 S 10/1976 Wattle
D244,569 S 6/1977 Laroye
4,035,606 A 7/1977 Browder
4,138,742 A 2/1979 Meeks
4,218,792 A 8/1980 Kogan
4,285,081 A * 8/1981 Price ..... A47C 7/383 297/391
4,345,347 A * 8/1982 Kantor ..... A47C 7/383 5/490
4,370,755 A 2/1983 Crumby
4,447,922 A 5/1984 Brochu
4,454,979 A 6/1984 Ikeda et al.
D284,248 S 6/1986 Challen
D285,512 S 9/1986 Bool
D286,965 S 12/1986 Eisler
D293,286 S 12/1987 Alfer
4,748,702 A 6/1988 Sandler
4,944,059 A 7/1990 Wall
D309,689 S 8/1990 Bool
D316,354 S 4/1991 Bool
D318,969 S 8/1991 Byrn
D327,175 S 6/1992 Mariol
D354,876 S 1/1995 Pace
5,414,881 A 5/1995 Terrazas
D360,554 S 7/1995 Righini
D363,186 S 10/1995 Reaves
D376,503 S 12/1996 Petersson
D381,232 S 7/1997 Jansson
5,682,632 A * 11/1997 Cotroneo ..... A47G 9/10 5/636
5,682,633 A 11/1997 Davis
D387,937 S 12/1997 Pujals, Jr.
D388,648 S 1/1998 Bates
D389,645 S 1/1998 Ermini
5,732,427 A 3/1998 Parnham
D396,594 S * 8/1998 Lefebvre ..... A47G 9/10 D6/601
5,884,331 A 3/1999 Barajas
D413,751 S 9/1999 Alyea
D414,974 S 10/1999 Marrone, II et al.
D417,568 S 12/1999 Pike
D419,024 S 1/2000 Lenahan et al.
D420,845 S 2/2000 Rumage
6,094,759 A 8/2000 Thompson
6,216,297 B1 4/2001 Lemke
D441,588 S 5/2001 Roberts et al.
D443,461 S 6/2001 Hall et al.
D444,981 S 7/2001 Hall et al.
D445,624 S 7/2001 Futagami
D450,517 S 11/2001 Darling et al.
D452,404 S 12/2001 Cameron
6,353,933 B1 3/2002 Love
6,371,641 B1 4/2002 Wilson, Jr.
6,381,784 B1 5/2002 Davis et al.
D466,750 S 12/2002 Landvik
6,578,218 B2 6/2003 Wassilefsky
D481,247 S 10/2003 Roberts et al.
6,668,400 B1 12/2003 Nichols et al.
D486,028 S 2/2004 Cathey
6,751,817 B1 6/2004 Leach
D492,874 S 7/2004 Fux et al.
D497,073 S 10/2004 Speare
D501,349 S 2/2005 Harris et al.
D503,062 S 3/2005 Nash
D521,300 S 5/2006 Mack
D522,300 S 6/2006 Roberts
D523,275 S 6/2006 Hawkins
7,082,633 B1 8/2006 Maarbjerg
7,089,617 B1 8/2006 Lauro
D528,830 S 9/2006 Kita
7,195,660 B2 3/2007 Little et al.
D542,071 S 5/2007 Chan
D553,412 S 10/2007 Cupo
7,322,057 B2 1/2008 Merlini
D576,438 S 9/2008 Peart
D582,713 S 12/2008 Baldwin
7,461,421 B1 12/2008 Faircloth et al.
D595,530 S 7/2009 Deetsch
D597,364 S 8/2009 Lindgren
D599,151 S 9/2009 Wilson
7,587,773 B2 9/2009 Littlehorn et al.
D607,682 S 1/2010 Presman et al.
7,644,990 B2 * 1/2010 Pearson ..... A47C 7/383 297/219.12
D609,931 S 2/2010 Young-il et al.
D610,365 S 2/2010 Young-il et al.
D611,285 S 3/2010 Berland et al.
D618,030 S 6/2010 Wang
D618,943 S 7/2010 Gold et al.
D619,402 S * 7/2010 Sternlight ..... D6/601
D628,845 S 12/2010 Guner et al.
D637,439 S 5/2011 Mettler
D637,440 S 5/2011 Mettler
D645,693 S 9/2011 Rothbard
D652,240 S 1/2012 Colman
D663,564 S 7/2012 Sclare
D664,799 S * 8/2012 Schwingendorf ..... D6/601
D665,212 S 8/2012 Schwingendorf et al.
D668,092 S 10/2012 Davis et al.
D669,724 S 10/2012 Kokoshari
8,316,488 B2 * 11/2012 Rojas ..... A47C 7/383 297/393
D672,567 S 12/2012 Sclare
D672,580 S 12/2012 Sclare
8,321,978 B1 12/2012 Fulton
D673,410 S 1/2013 O'Connell
8,566,985 B2 10/2013 Kim
D701,063 S 3/2014 Myers
D704,963 S 5/2014 McNeil et al.
D711,173 S 8/2014 Liao
8,914,927 B1 12/2014 Leach
D721,520 S 1/2015 Jensen
D722,449 S 2/2015 Krishtul
D723,838 S 3/2015 Nelson
D727,069 S 4/2015 Ahroon
D728,272 S 5/2015 Zimmerman
D731,813 S 6/2015 Durkin
D732,313 S 6/2015 Fux
D732,847 S 6/2015 Jan
D733,462 S 7/2015 Pellegrini
D746,080 S * 12/2015 Mittelstadt ..... A47C 7/383 D6/601

(56) References Cited

U.S. PATENT DOCUMENTS

D750,926 S 3/2016 Line et al.
D752,899 S 4/2016 Ueno
D754,354 S 4/2016 Revere
D759,991 S 6/2016 Jing
9,615,682 B1 * 4/2017 Maddocks ..... B60N 2/80
D787,232 S * 5/2017 Kassab Arabo ..... B60N 2/885 D6/601
D815,861 S * 4/2018 Kassab Arabo ..... A47C 7/383 D6/601
D823,027 S * 7/2018 Zou ..... A47C 7/383 D6/601
2002/0050007 A1 * 5/2002 Kim ..... A47G 9/10 5/636
2003/0135926 A1 7/2003 Ong
2004/0060116 A1 4/2004 Matthews Brown
2004/0068799 A1 4/2004 Wilson
2004/0255385 A1 12/2004 England
2005/0039241 A1 2/2005 Khan
2005/0278852 A1 12/2005 Wahrmund et al.
2006/0103225 A1 5/2006 Kim
2006/0267392 A1 * 11/2006 Charnitski ..... B60N 2/885 297/393
2007/0067915 A1 3/2007 Pryor
2007/0143927 A1 6/2007 Noro et al.
2008/0182478 A1 7/2008 Smoot et al.
2008/0216243 A1 9/2008 McQuoid
2008/0222813 A1 9/2008 Aikman
2009/0013471 A1 * 1/2009 Yang ..... A47C 7/383 5/640
2009/0145442 A1 6/2009 Hecox et al.
2009/0151077 A1 6/2009 Heinsius et al.
2010/0026077 A1 2/2010 Tarumi et al.
2010/0175192 A1 * 7/2010 Aiken ..... A47C 20/021 5/632
2011/0290834 A1 12/2011 Pelz et al.
2011/0309122 A1 12/2011 Sternlight et al.
2012/0005801 A1 1/2012 Parr
2012/0073056 A1 3/2012 Freund et al.
2012/0284924 A1 11/2012 Pratt et al.
2013/0198961 A1 8/2013 Davis et al.
2014/0208693 A1 7/2014 Fux
2014/0310877 A1 * 10/2014 Sternlight ..... A47C 31/00 5/639
2014/0317849 A1 10/2014 Legrand et al.
2015/0108802 A1 4/2015 Krishtul
2015/0113734 A1 4/2015 Arabo
2015/0126349 A1 5/2015 Ishihara et al.
2015/0173516 A1 * 6/2015 Erbe ..... A47C 7/383 5/636
2015/0201767 A1 7/2015 Davis et al.
2015/0265075 A1 9/2015 Liu et al.
2016/0073801 A1 3/2016 Shin et al.
2016/0183685 A1 6/2016 Kang
2017/0065108 A1 * 3/2017 Thorn ..... A47C 7/383

* cited by examiner

MINIATURIZED TRAVEL CUSHION HAVING INNER OPPOSING LEDGE CONFIGURATIONS FOR PROVIDING SPACING FOR A WEARER'S EARS ALONG WITH SECONDARY DIRECTED PRESSURE GENERATING PORTIONS FOR TREATMENT OF TRAPEZIUS BACK MUSCLES

CROSS-REFERENCE TO RELATED APPLICATIONS

This application is a Continuation-in-part of U.S. application Ser. No. 15/376,092, filed Dec. 12, 2016. The '092 application is a Continuation-in-part of U.S. Ser. No. 14/520,950 filed on Oct. 22, 2014. The '950 application claims the benefit of U.S. Provisional Application 61/896,231 filed on Oct. 28, 2013, the contents of which are incorporated herein in its entirety.

BACKGROUND OF THE INVENTION

Field of the Invention

The present invention is discloses an improved miniaturized pillow design for use by individuals, such including but not limited to travelers in an upright seated position in a plane, a bus, train or the like. In particular, the present invention provides a cushioned miniaturized pillow design which combines inwardly or recessed ledge surfaces on opposing inner surfaces of the main body portion of the cushion, the ledges providing additional support for the front head and neck of the user as well as providing clearance for a user's ears. In combination, the pillow also includes a further pair of downwardly directed, secondary and pressure generating portions which provide treatment and massage relief to the upper back (trapezius) muscles of the upright seated individual.

Background Discussion of the Relevant Art

The prior art discloses variations of convertible cushions, pillows and the like. A first example of this is set forth in U.S. Pat. No. 3,879,775 to Iwata, which discloses a cushion usable as a pillow or a sofa-cushion as well as a bag containing a blanket or the like which can be taken out to cover the user's body and also can be used as a pillow or a sofa-cushion, after the blanket or the like has been taken out. When the blanket or the like is not in use it can easily be kept inside the bag or the cushion to clear up the surroundings, and the cushion with the blanket or the like kept inside is also usable as a cushion as well.

Wilson, U.S. Pat. No. 6,371,641, teaches a collapsible seat and cape incorporated into a luggage style portable container which includes a carrying strap. A pair of identical internal pockets that extend cross the full length and width of the bag and are openable by a zipper or other quick opening closure. A three dimensional rectangular and foam shaped cushion is inserted into one of the pockets, the other containing a cape.

Ong, US 2003/0135926, teaches a combination of a pillowcase and a cover constructed the so that the pillowcase is permanently attached to the central region of the cover and the cover may the folded and stuffed into the pillowcase or alternatively spread out to extend laterally from the pillowcase. The pillowcase is formed of front and rear panels. The front panel is permanently secured to the central region of the cover. The front and rear panels of the pillowcase are permanently secured together along only a portion of a mutually common enclosing perimeter, and are releaseably secured together along the remainder of that perimeter. The orientation of the rear panel is reversible so that it may reside exposed atop the cover with the front panel concealed therebetween when the cover is withdrawn from the pillowcase and spread out laterally therefrom. Alternatively, the rear panel may be reversed in orientation relative to the front panel so that the cover may be folded and stuffed in between the mutually facing reverse surfaces of the front and rear pillowcase panels and encapsulated within the pillowcase by closure of the releaseable fasteners. A zipper may be employed to form the releaseable fasteners on the pillowcase panels.

Smoot, US 2008/0182478, discloses an apparatus for a pillow that converts into a highly-developed, three-dimensional toy figure that, in certain embodiments, has a life-like shape. The apparatus includes a pillow or a hollow body with one or more clasping mechanisms. When engaged, the clasping mechanisms shape the apparatus into the soft, toy figure. When disengaged, the clasping mechanisms allow the apparatus to serve as a pillow with a soft, comfortable, relatively-flat surface for sleeping. Certain embodiments of the apparatus include an internal cavity that houses an extractable blanket to provide additional bedding.

Fulton, U.S. Pat. No. 8,321,978, discloses a child's stuffed pillow and a play item concealable within a pocket in the pillow. Two cushioning members, each including a cushioning medium and having a flexible fabric covering thereover, are attached together as by sewing in a side-by-side arrangement around common perimeter edges of inner covering panels of the coverings. A pocket is formed between the inner covering panels into which a play item is concealable within the pocket. A tether is connected between the bottom of the pocket and the neck of the play item to hold the play item in close proximity to the pocket during play wherein the child may grasp the play item like a handle of the pillow.

McQuoid, US 2008/0216243, discloses a pillow system comprises a pillow having a pocket extending inside the pillow that contains one or more articles having a theme which corresponds to the theme of the outer surface of the pillow. The pillow has a top panel and a bottom panel joined at the periphery to define a peripheral edge and cushioning material disposed inside. The outer surface, having a cover theme, substantially covers one or both of the panels. The pocket extends into and is substantially enclosed by the cushioning material. Access to the pocket is through a pocket inlet along a portion of the peripheral edge. A closure mechanism, such as a zipper, at the inlet substantially closes the pocket to enclose the articles inside. The articles have an article theme that corresponds to the cover theme. If desired, the pillow can also have a theme shape that corresponds to the cover and article themes.

Finally, US 2009/0151077 to Heinsius et al., teaches a pillow which comprises a storage compartment which can be accessed by putting one's arm into a pillow mouth opening generally central to the front side of a pillow. In a preferred embodiment, an opening cover is provided which serves to further conceal the pillow mouth. Preferably, a sash which circumscribes the pillow is employed, and a user may put his or her hand under the sash to access the pillow mouth and the storage compartment to which it leads. The compartment may store any objects and is desirable for storage of items that need to be hidden but readily accessible such as contraceptives, self-defense items, or household objects such as controls or keys.

SUMMARY OF THE PRESENT INVENTION

The present invention updates the cushion portion included in the portable or miniaturized combination foam cushion and poncho style blanket assembly of FIGS. 1-9, such including but not limited to use during travel. The cushion includes a three dimensional and contoured material configured to be arrayed in either of first or second inverted positions in order to provide support to the back of the user's head and neck.

In one version, the assembly includes an outer covering having a zippered edge for receiving a contoured cushion. The cushion may be constructed of a soft foam or memory foam material, and in use either within the zippered cushion or separately, exhibits multiple three dimensional contoured surfaces for conforming to the shape of the user's neck and for providing cervical spinal support.

A pair of main lateral cushion portions extend in opposite directions from a central body of the cushion. The main cushion portions each include an inner opposing recess defined by a ledge, such providing a combination of additional support for the front head and neck of the user, in combination with clearance for a user's ears for any of audial capability (the cushion doesn't cover the ear so that the person can still hear and communicate), the wearing of jewelry on the ears and/or the use of portable headphones, such as of the in-ear variety. The pillow design further includes a secondary and downwardly directed pair of projections associated with the redesigned cushion further define pressure generating portions which provide treatment and massage relief to the upper back (trapezius) muscles of the upright seated individual.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the following described illustrations, the present invention discloses a combination and miniaturized travel kit including a form-supporting and foam cushion article which can be contained within an optinoal zippered outer covering in combination with a folded blanket, such further including a poncho style blanket. As will be described below, the pillow may also include a cushion constructed of a foam type material, such exhibiting a plurality of form supporting locations adapted for engaging the user's upper back, neck and adjoining head, such as in order to provide support to the user's upper cervical vertebrae when leaning backwards against an elevated support surface, the cushion conforming to the shape of the user's neck.

In additional variants, and as will be further described below, the outer zippered covering contains the cushion and, optionally, the associated folded blanket or poncho. The cushion is inserted within the interior of the zippered article, again in order that the cushion can individually or, in combination with the folded blanket/poncho, provide cervical spinal support to the rear of the user's head and underside of the user's neck. It is further understood that one non-limiting variant of the present invention includes the provision of a memory foam construction for the cushion material.

The blanket, as will be further described, can include in one non-limiting variant a poncho style blanket with a fourteen inch straight line opening (such not limited to any specified opening at a fold-over midsection location and which can also include any type of circular, elliptical or oval shaped opening). As will be further described, the outer containing (or pillow) case can be configured so that a side edge extending zipper portion can extend along any of a single, dual or other multiple sided fashion, such further envisioning rounded, oval or other shaped pillows not limited to a generally rectangular shape. In this fashion, the zipper is utilized to access the interiorly held blanket (additional variants covering two and three sided unzipping).

Other design features can include the incorporation of a drawstring travel bag (see FIG. 7) such as used with a packaging for initial retail sale. The cushion can further be configured for particular uses not limited to sofa, dorm, office, camp and sleepover applications, and the selected design can also provide effective head and neck support in either of upright or reclined positions.

Figure 1:
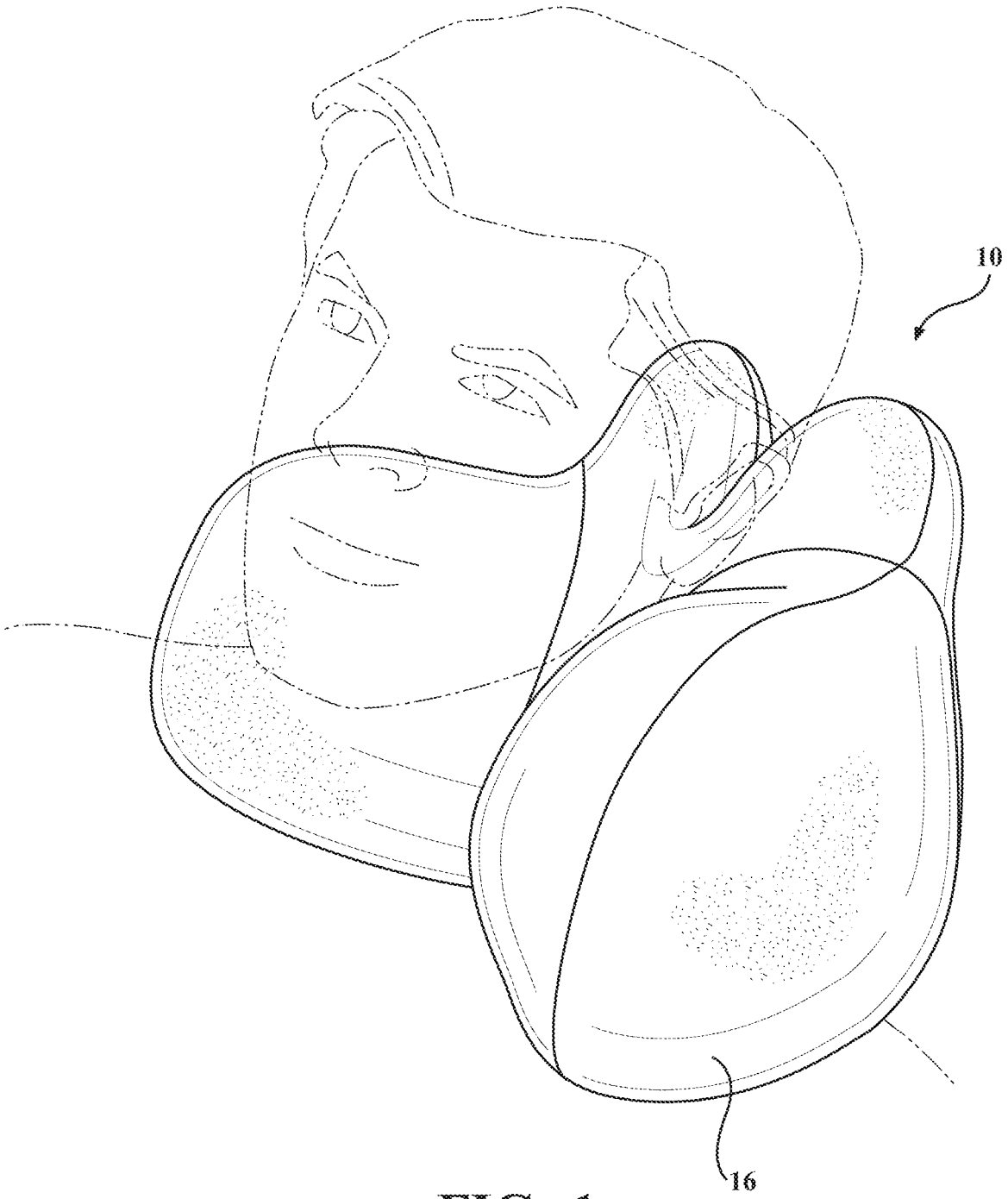
FIG. 1 is an environmental perspective view of one embodiment of the combination travel cushion and poncho style blanket in which contoured and valley defining surfaces provide for upper cervical support of the users neck and back of head.
Figure 2:
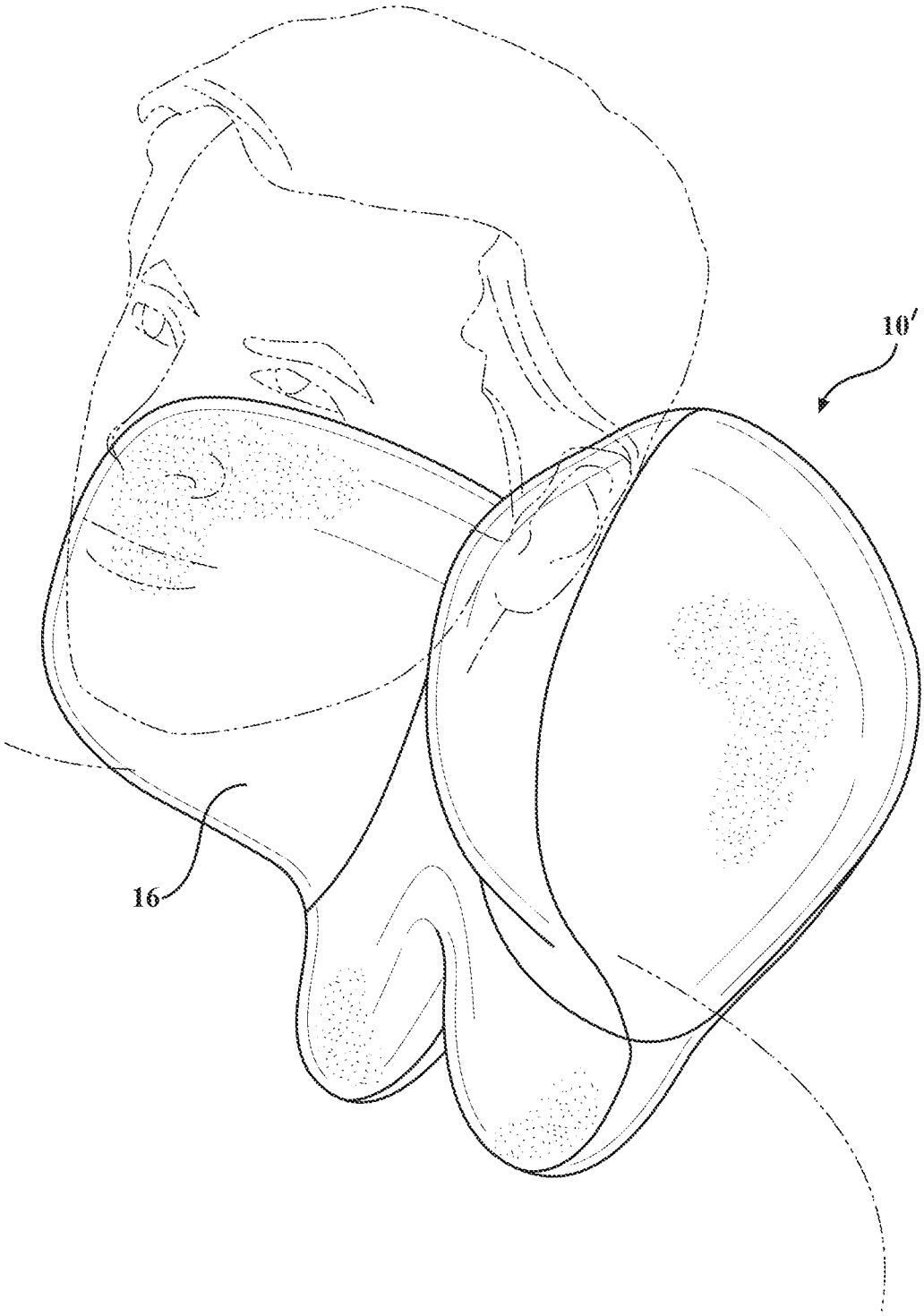
FIG. 2 is a further environmental perspective similar to FIG. 1 and in which the combination device is inverted for providing varied cushioning support.
Figure 3:
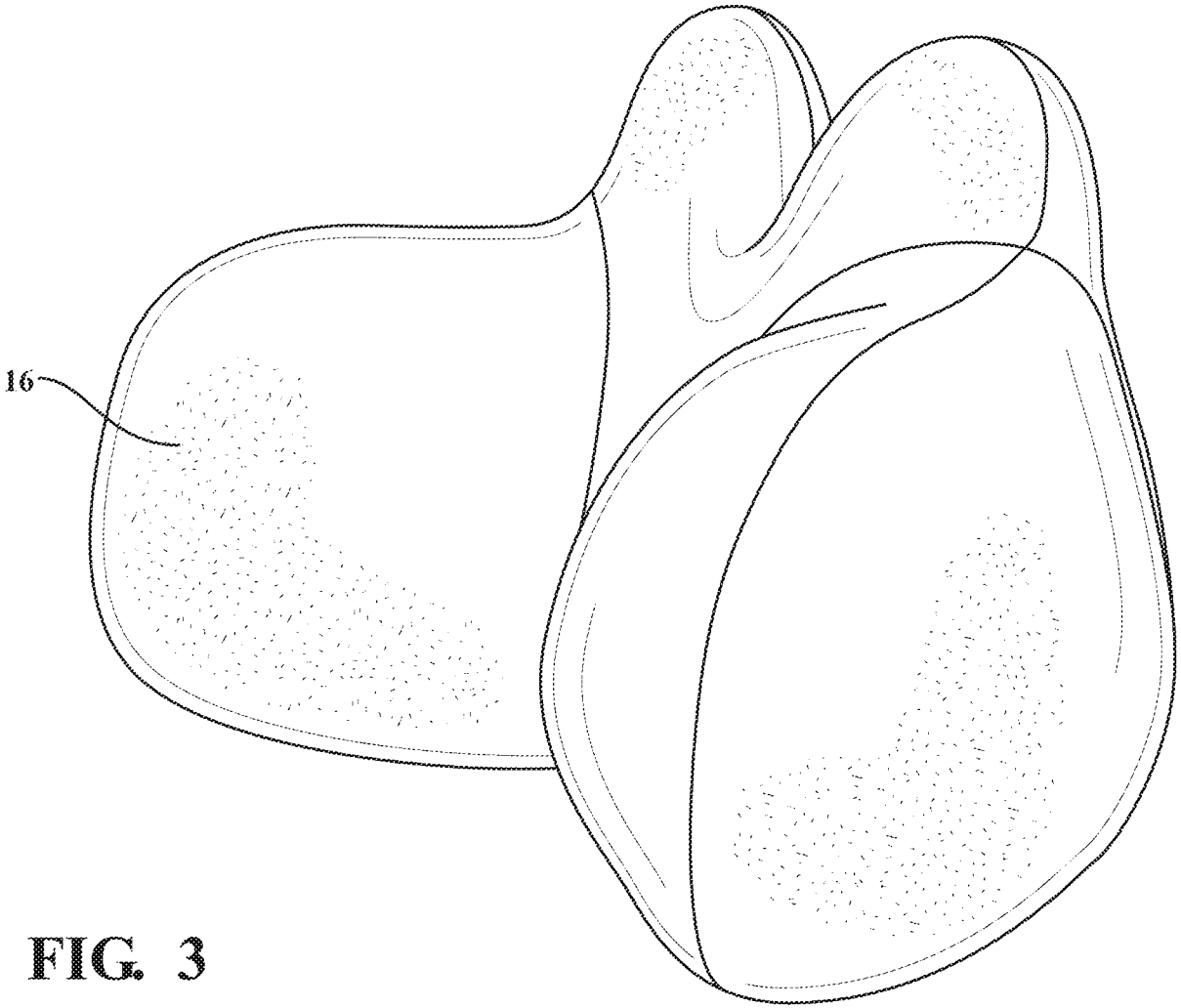
FIG. 3 is an enlarged perspective similar to that shown in FIG. 1 and in which multi-contoured and support defining surfaces of the cushion are depicted in better detail.

Given the above, and referring initially to FIG. 1, an environmental perspective view is shown at 10 of one embodiment of the present combination article and assembly which exhibits contoured and valley defining surfaces provide for upper cervical support of the users upper back, neck and back of head. As will be described in further detail, FIGS. 1-3 depict the combination article in a combined assembly and which, as further shown in FIG. 4, includes a multi component kit having a memory foam contoured cushion 12 and folded (poncho style) blanket 14, these being contained in combination within a zippered or otherwise slit openable outer covering 16. The covering mimics or exhibits a similar configuration as the internally supported memory cushion 12, such enabling the cushion to be used both within the covering (optionally along with the blanket 14), as well as without.

Figure 4:
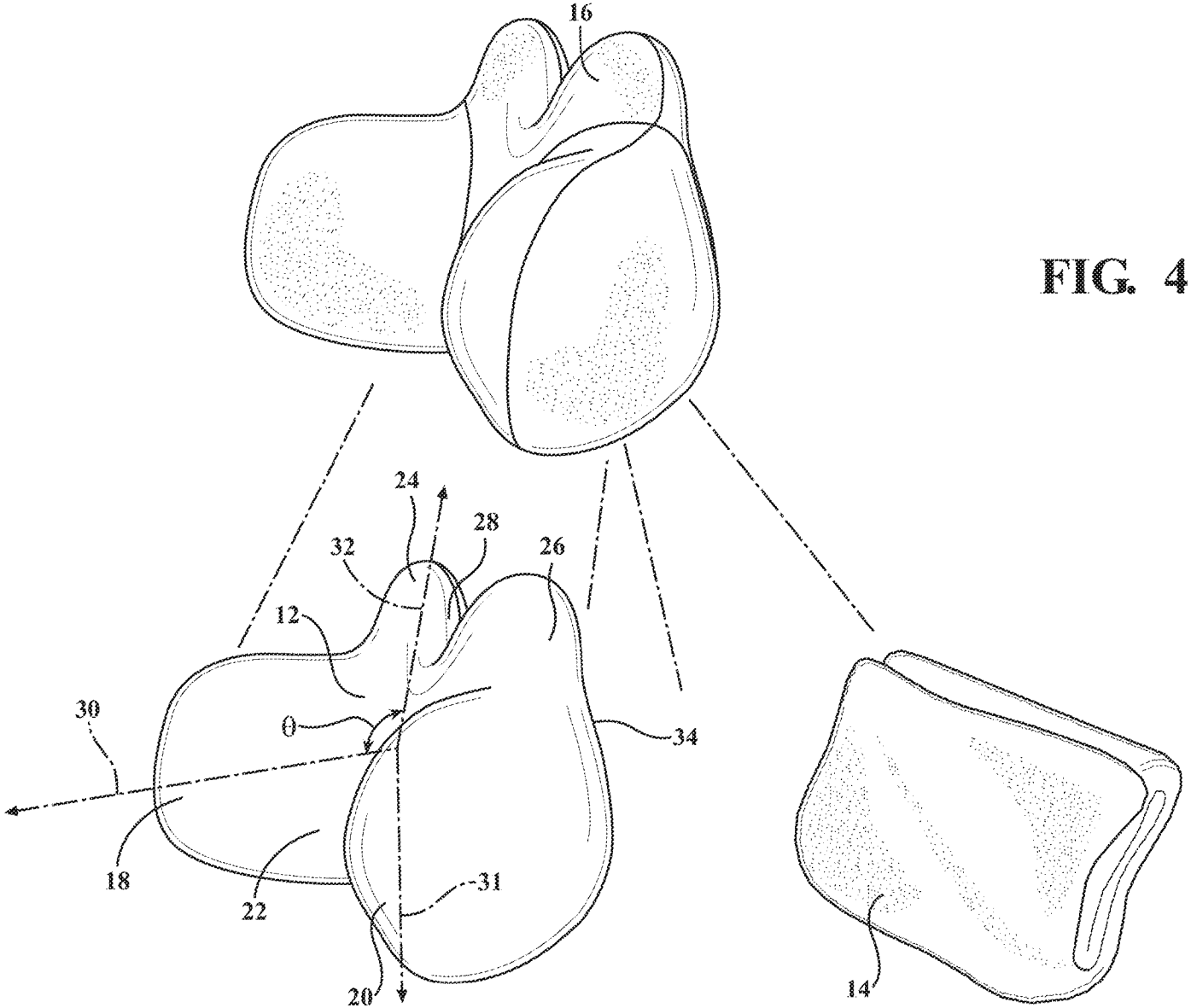
FIG. 4 is an exploded view of the combination travel assembly and depicting the contoured and foam supporting cushion and folded blanket in combination with the outer secured covering, such expanded to mimic the overall shaping of the cushion with the folded blanket or wearable poncho filling a volume adjoining a backside of the cushion.

Description of the cushion will be had with reference to FIG. 4, it being noted that the covering 16 shown in FIGS. 1-3 contains the cushion 12 in a form fitting manner providing the overall article with a consistent three dimensional configuration (covering 16 with inserted cushion 12) as the exploded view of the cushion 12 separated from the covering 16 as described in FIG. 4. For that reason, reference is made to FIG. 4 for an explanation of the contours of the cushion 12 which are consistent with the form fitting depiction of the combined cushion and outer covering 16 in FIGS. 1-3.

Figure 6:
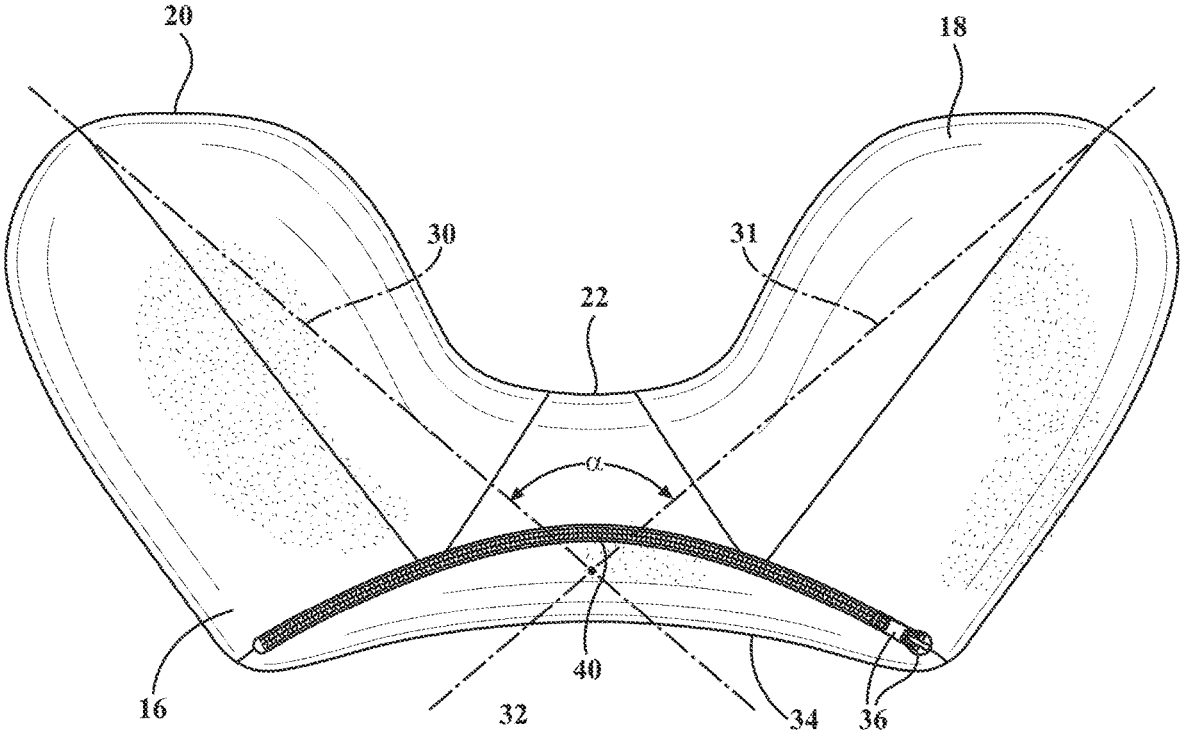
FIG. 6 is a rotated underside exterior plan view of the assembly in FIG. 5 depicting the zippered bottom edge.

As best shown in FIG. 4, the cushion 12 again can include a memory foam construction and exhibits a pair of main and forward and opposite/outward projecting mounds 18 and 20 extending relative to an overall body of the cushion 12. The main projecting mounds 18 and 20 define an arcuate valley profile 22 (this also shown in the underside plan view of FIG. 6 in which the cushion 12 is again contained within the form fitting covering 16) and, as shown in each of the first ands second inverted environmental depictions of FIGS. 1-2 in which the cushion 12 is again inserted within the outer covering 16, provides support to either of the rear of the neck (FIG. 1) or the underside back of the wearer's head (FIG. 2) depending upon the positioning of the cushion.

As further shown in FIG. 4, a further pair of smaller mounds 24 and 26 project from an end surface of the main cushion body 12 (such being generally corresponding to a top surface of the cushion as shown in each of FIGS. 1, 3 and 4 as well as an inverted bottom facing surface in the environmental depiction of FIG. 2. The mounds 24 and 26 are smaller than the forward/outward projecting mounds 18/20 and define therebetween a proportionally smaller cleavage or valley 28.

As also shown in FIG. 4, a general axis of travel of a centerline 30 extending through a largest axial extending depth or direction of a first mound 18 with a further axis of travel of a centerline 31 extending through a largest linearly extending section of the second mount 20, both extending at an angle θ relative to a further centerline 32 extending generally crosswise or perpendicularly through a largest linearly section of the smaller mounds 24/26. Each largest section corresponds to a center location of each mound and the angle θ can, as shown in FIG. 4, be greater than a 90 degree perpendicular or, as is further envisioned, the cushion 12 can be reconfigured so that the pairs of mound-like and undulating surfaces exhibit a different surface orientation.

A further angle α is defined by the intersection of the extending centerlines 30 and 31 (see FIG. 6) and which can likewise be in a range of about 90° or greater. The combination of the angles θ and a provides the cushion with an overall contour support surface best suited for providing cushioning and firm support to the user's upper back, neck and back of lower head with the cushion in either of the positions of FIG. 1 or 2.

As previously shown in FIG. 1, the selected environmental depiction shows the smaller pair of mounds 24/26 (again contained within the outer covering 16) supporting the back of the user head (in proximity to the upper most C1-C3 vertebrae and in combination with the larger pair of mounds 18/20 surrounding the sides of the wearers neck), whereas the inverted arrangement (see at 10') in FIG. 2 shows the smaller mounds 24/26 supporting the user's shoulders with the intermediate cleavage 28 generally overlaying the upper vertebral column and the sloping sides of the main mounds 18/20 surrounding the sides and back of the neck.

Figure 5:
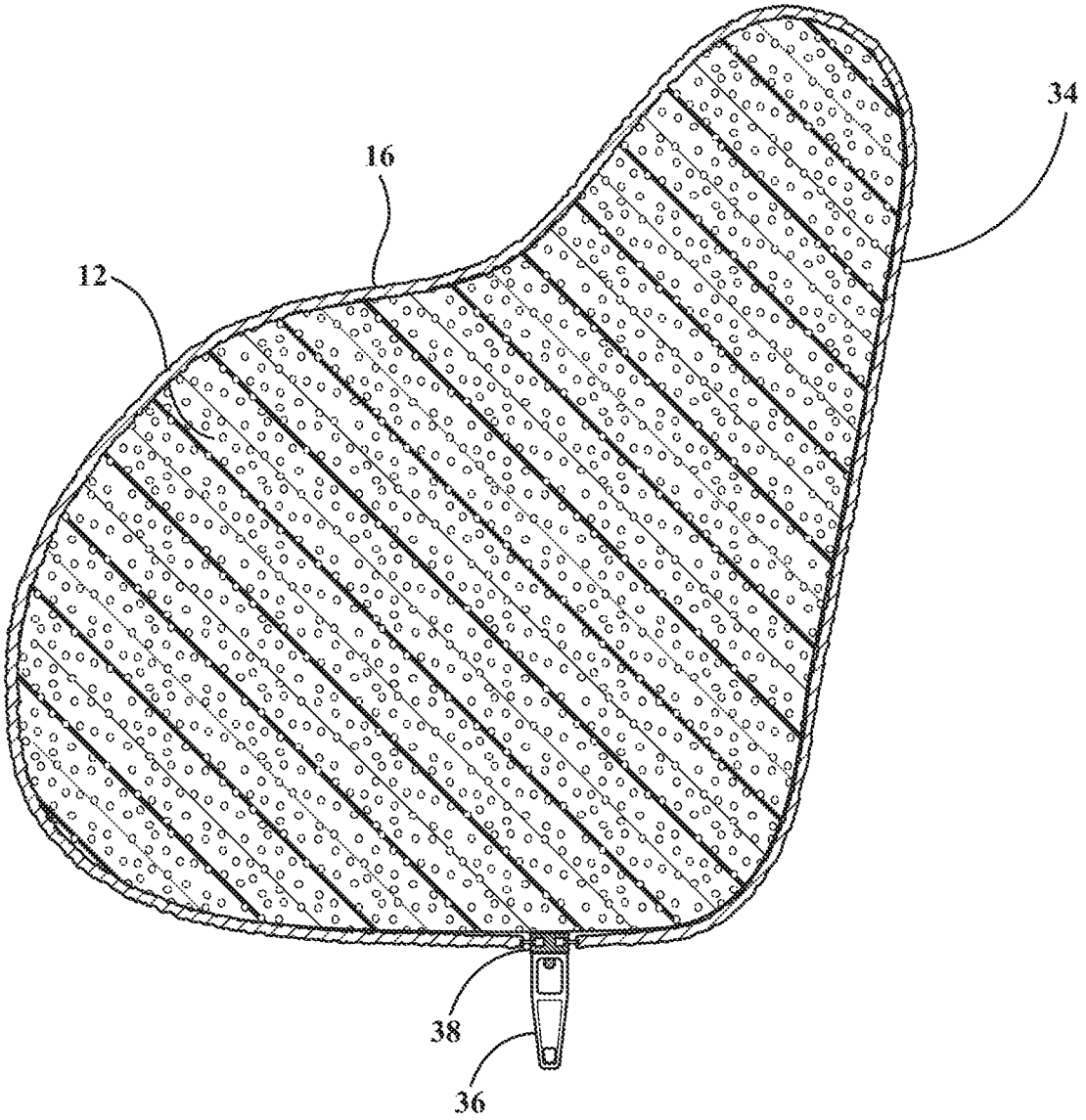
FIG. 5 is a plan cutaway of the assembly depicted in FIGS. 1-4 and illustrating an interior arrangement of the form supporting cushion with the form mimicking outer cover, such further including a bottom zippered edge.

The rear surface of the cushion 12 (as best shown at 34 in FIGS. 5-6 but largely hidden from view in FIG. 4) exhibits a slight but less pronounced slope and, when installed within the outer pillowcase like covering 16, conforms to the outline of the cushion. Although not shown, the covering 16 can be reconfigured somewhat larger than the dimensions of the covering to provide room for inserting the wearable poncho/blanket in either of a folded or rolled blanket in rear abutting fashion against the cushion 12 when inserted within the zippered interior 16 of the outer covering 16. As further shown in FIG. 6, a slit or opening formed in the outer case or covering 16 can include a single or dual pair of pullers 36 and attached sliders 38, these engaging and joining a pair of meshing coils (see collectively at 40) for opening and reclosing a bottom edge of the outer covering 16 to receive therein either or both of the cushion 12 and wearable poncho (see at 14' in FIG. 7).

Figure 7:
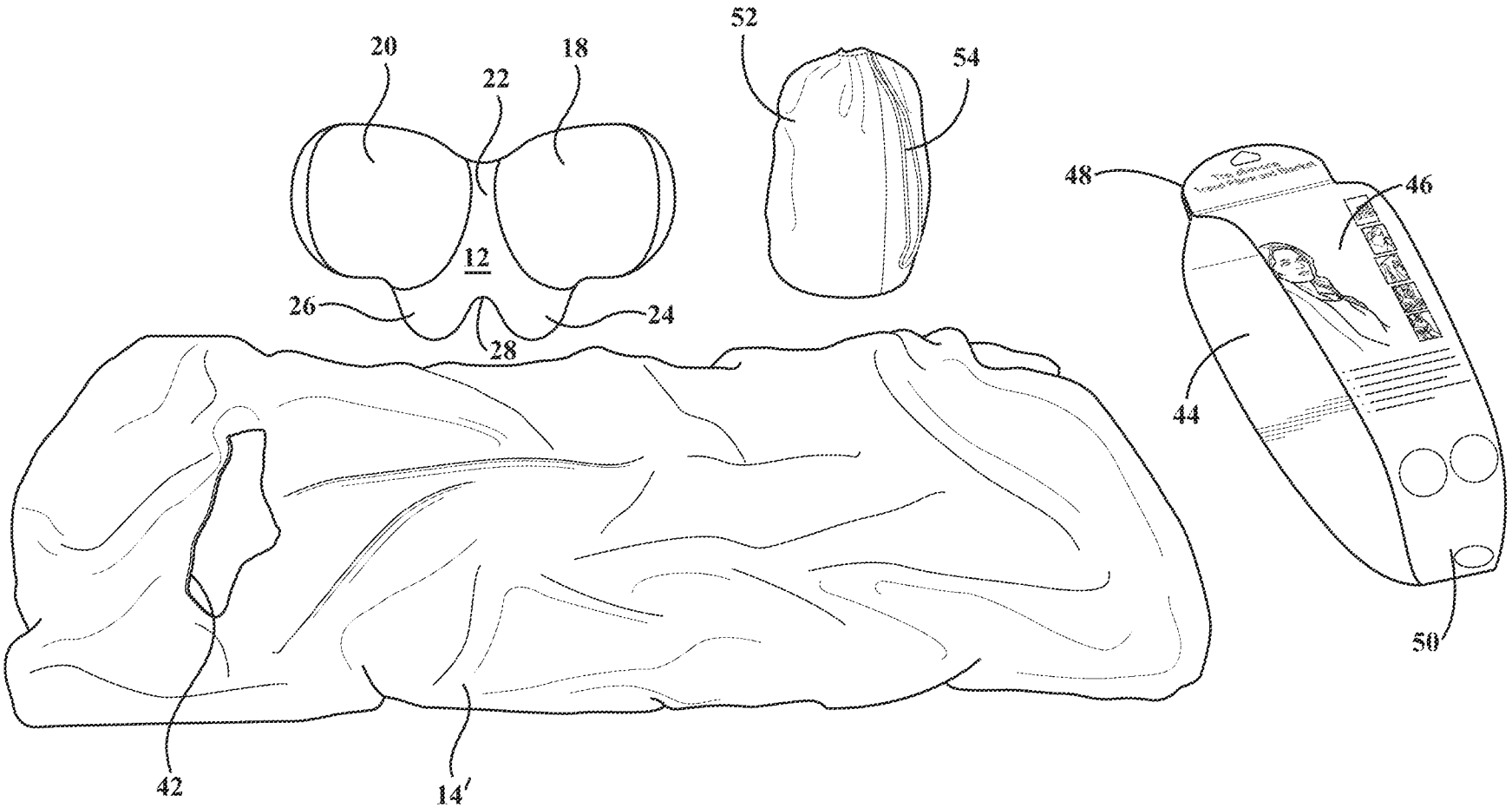
FIG. 7 is an exploded illustration of a further variant of the travel assembly of the present invention and depicting a packaging configuration combining the form supporting cushion, an unfolded poncho style blanket and a zippered carrying bag.

The outer covering 16 can exhibit a textured surface which can include without limitation any type of plush, velour or other soft consistency. Likewise, the blanket 14 can include either of a standard shape or, in a further embodiment, a poncho style wearable item (again at 14') exhibiting a closed inner perimeter edge 42 for facilitating installation over a wearer's head and for supporting the poncho on the wearer's shoulders. In this fashion, and upon inserting the cushion 12 and poncho style blanket 14' into the zippered interior of the covering 16, the covering adopts a smooth three dimensional surface appearance FIG. 7 is an exploded illustration of a further variant of the travel assembly of the present invention and depicting a packaging configuration, this including a pair of main panels 44 and 46 connected at inwardly angled and joined upper 48 and lower 50 ends. In a display variant, the packaging combines and supports in an inserted and retail displayed fashion each of the form supporting cushion 12, an unfolded (or rolled or reverse folded) poncho style blanket 42 and a zippered carrying bag, see as further shown at 52 and which can also include a carrying lanyard 54.

Figure 8:
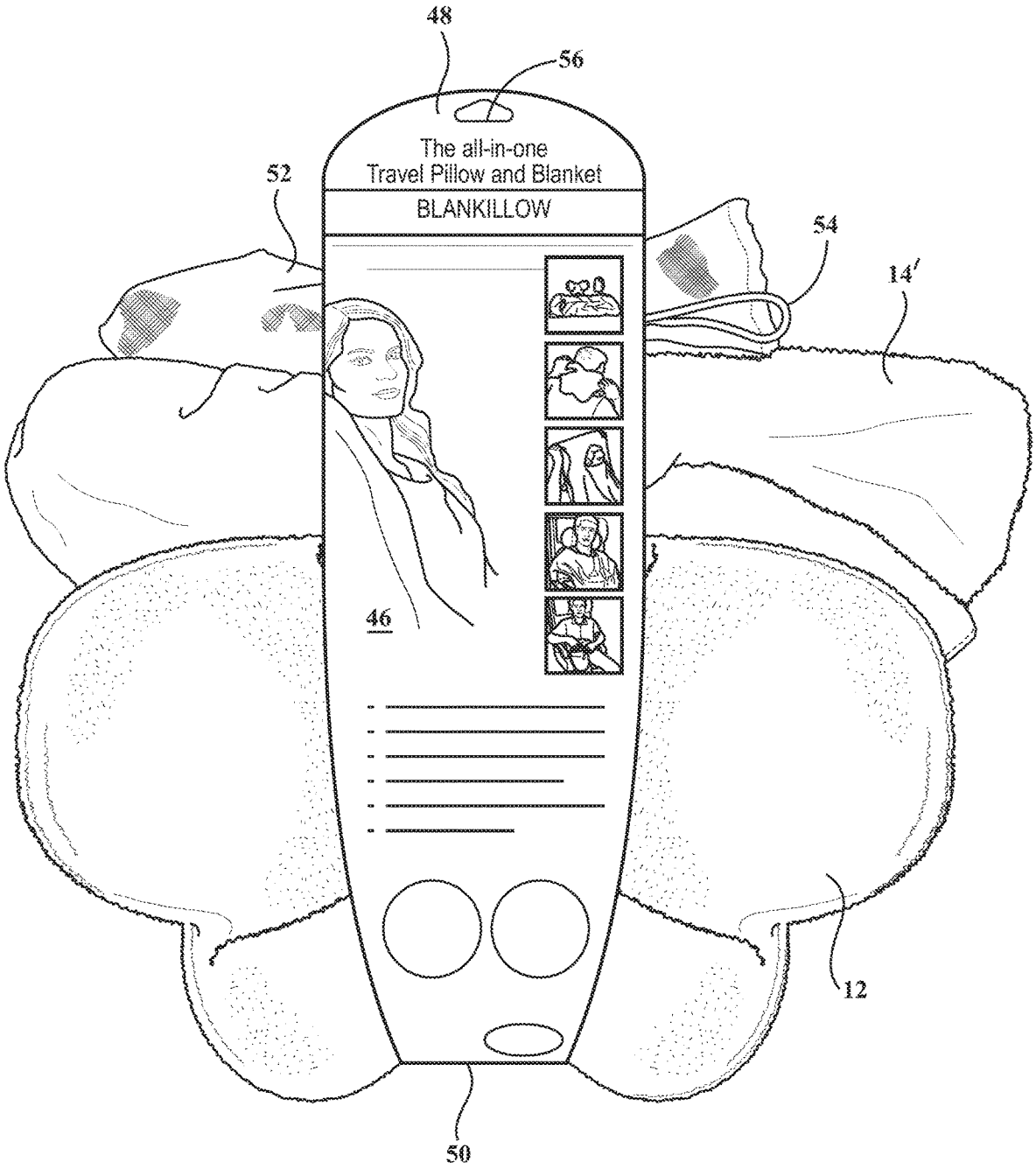
FIG. 8 is an assembled packaging view of the assembly in FIG. 7.

FIG. 8 is an assembled packaging view of the assembly in FIG. 7 and which depicts and displays the combination of cushion 12, blanket 14' and outer covering/carrying bag 52 in an independently displaying and commercially inviting manner. An aperture (see inner perimeter rim 56) is configured in the upper joined end 48 of the packaging panels 44/46 and adapts the retail package display for suspending from a hook or the like (not shown) such as in a pre-purchased configuration. Upon purchase, the packaging is discarded or recycled, following which the bag 52 is utilized for storing the cushion and poncho/blanket during periods of non-use.

It is further understood that the blanket may comes in many different fabric patterns, plain or colorful, designed material hanging off the ends for extra style. Without limitation, the blanket can be constructed of cotton, wool, polyester, and other fabrics.

Depending upon the variant disclosed, the blanket/wearable poncho easily folds and fits into the zipper entry of the pillow case. As again further illustrated the blanket in a poncho variant exhibits a hole or other shaped incision (such as a straight cut) in the top quarter section in the middle, making the blanket cover the almost the entire front of the person's body, while the back only to upper back shoulders is covered. It is also envisioned that different sized blankets can be used with different sized and configured pillows.

The memory cushion 12 (as again best depicted in the cutaway of FIG. 5) is again understood to be made of a soft or memory foam type material for conforming to the shape of one's neck, with the contour or lump designed to fit perfectly underneath ones neck, such as to define a lumped roll. The travel combination disclosed is further understood to come in multiple sizes, including a smallest such as in use with an airplane blanket contained in the pillow. Additional features can include a small fabric handle in the seam of one end of the pillow for easy carry-ability. Other features of the pillow again include the zipper extending along any number of interconnecting sides of the seam, typically from one to three sides.

Without limitation, the pillow can exhibit a first decorative side (the side where the blanket lays inside), as well as a flip side which exhibits the lump cushion adapted to fit easily under the neck. As further previously described, a decorative side of the pillow can be additionally designed to sit on a sofa for design.

Figure 9:
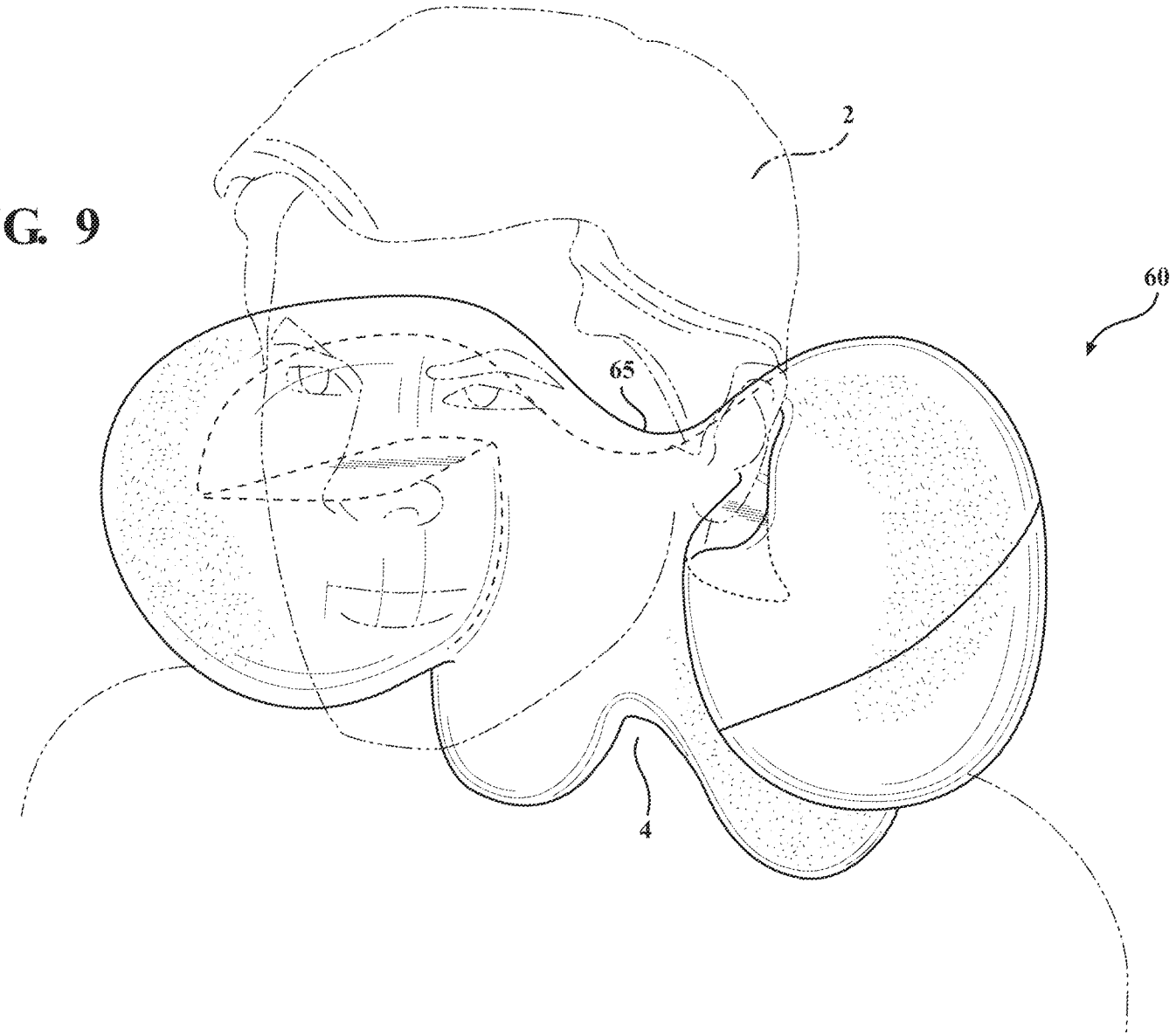
FIG. 9 is an environmental view of the cushion according to a further embodiment positioned behind the head and neck of an upright seated wearer and providing a combination of support locations including above the wearer's back/trapezius muscles.
Figure 12:
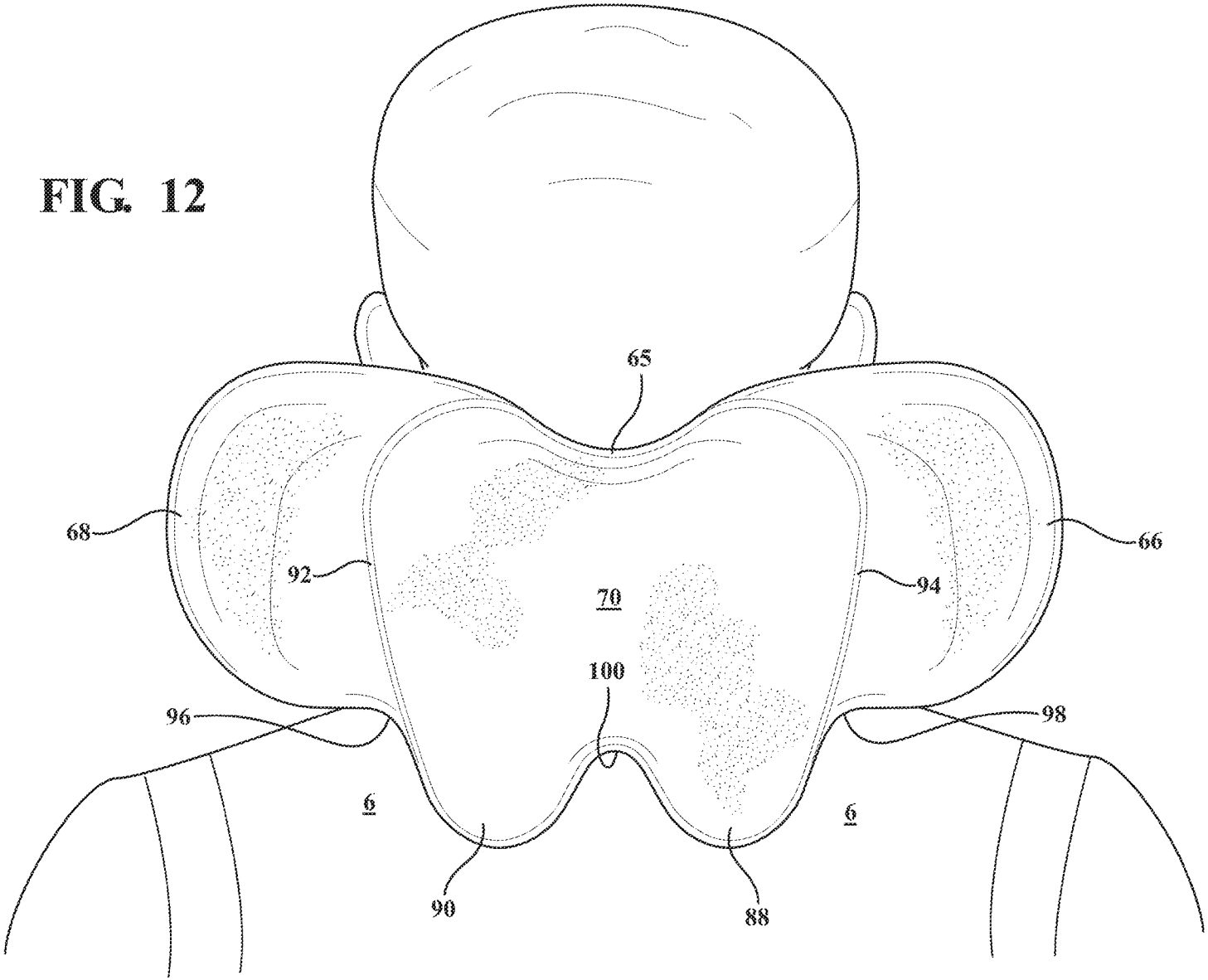
FIG. 12 is an environmental view based on FIG. 11 and depicting the supporting aspects of the cushion including that provided by the downwardly directed and secondary pair of projections/portions which provide pressure support to the user's trapezius (upper back) muscle group.
Figure 13:
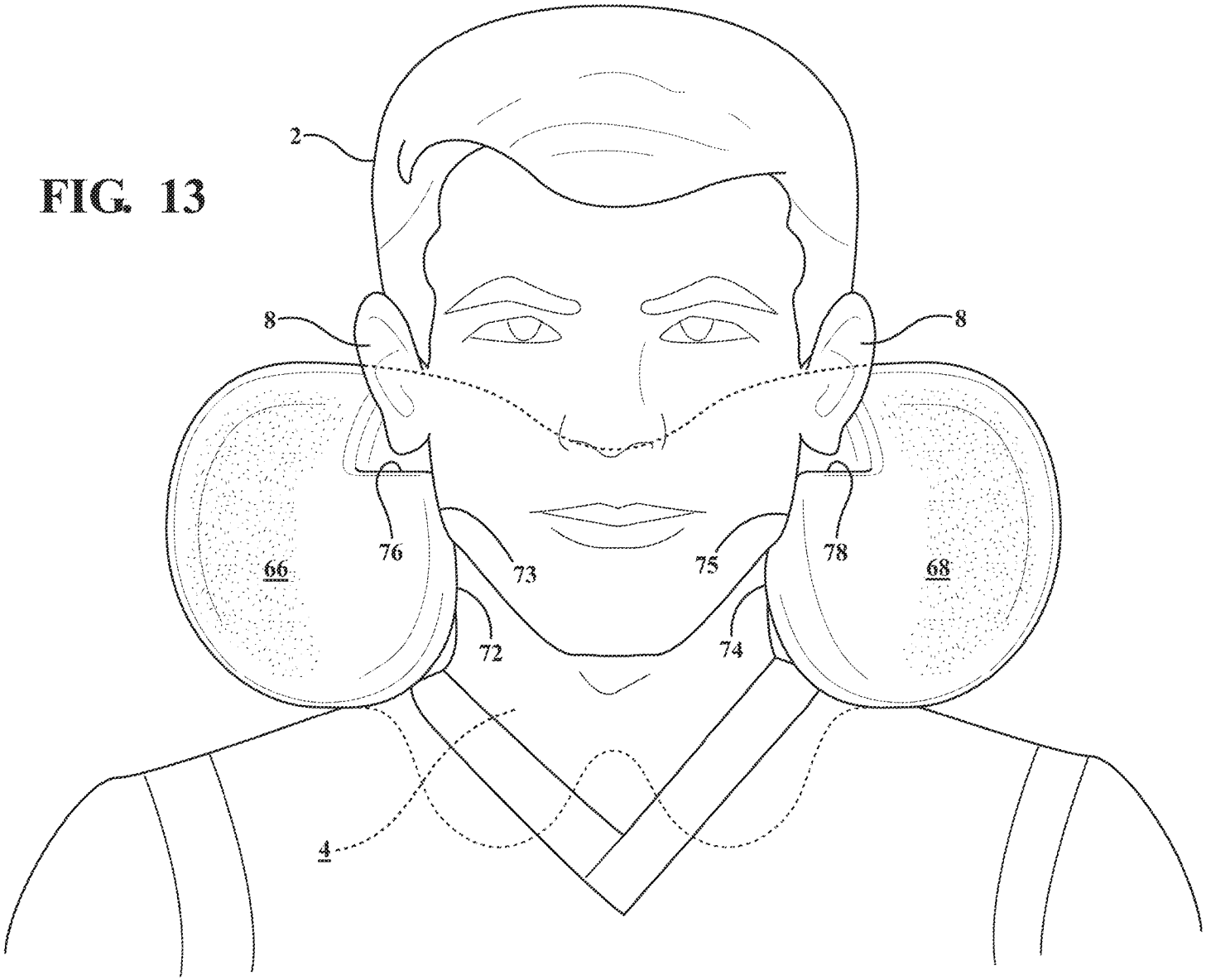
FIG. 13 is a 180° rotated front view of FIG. 12.

Proceeding on to FIG. 9, an environmental view is generally shown at 60 of a cushion according to a further embodiment, and such as is illustrated positioned behind the head 2 and neck 4 of an upright seated wearer and providing a combination of support locations including above the wearer's back/trapezius muscles 6 (see also FIGS. 12-13). The cushion 60 is similar in construction to that shown at 10 in FIG. 1 and, referring further to FIG. 10 which provides an enlarged and partially cutaway illustration of FIG. 9, depicts both a surface covering 62 and inner memory foam or like construction 64.

The cushion shaping is optimized for use by individuals in an upright seated position, such including any environment not limited to home or travel. That said, the applications of the present invention include the cushion having suitably small dimensions optimized for use in travel environments including planes, trains, automobiles and the like.

Figure 10:
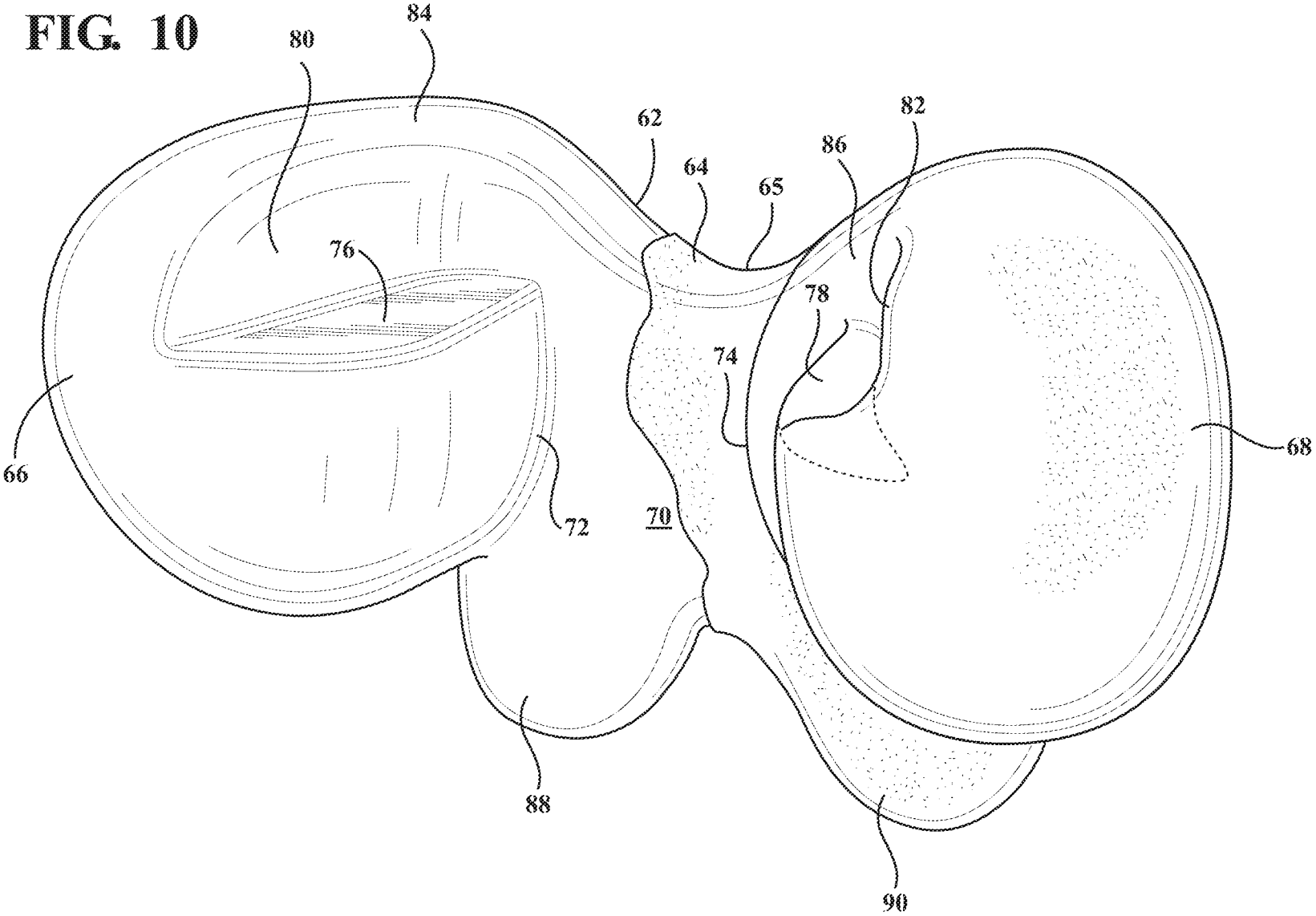
FIG. 10 is an enlarged and partially cutaway illustration of the cushion in FIG. 9, depicting both the surface covering and inner foam construction, and better showing the pair of inner opposing ledges defining the recessed locations for providing clearance for the user's ears.

As again best shown in FIG. 10, the cushion exhibits an irregular shaped and three dimensional body with a pair of primary and laterally oppositely projecting portions 66 and 68 which are adapted to cushion opposite sides of the wearer's head 2. The primary projecting portions are separated by an intermediate and substantially flattened interior portion of the cushion, this further shown at 70, and so that sloping and merging locations (at 72 and 74 respectively for portions 66 and 68) converge into the main flattened interior portion 70 (such further terminating in an contoured upper middle edge 65 which is slightly concave for the purpose of providing adequate cushioning support when placed in contact with the back of the user's head for supporting the base of the skull in proximity to the upper rear of the neck.

The primary projecting portions 66 and 68 are each further configured by a horizontal ledge, shown at 76 for portion 66 and further at 78 for portion 68, these being formed into the inner opposite facing and sloping surfaces so that each ledge extends between the outermost point of each portion 66/68 to interior portion contiguous to the sloping and merging locations 72/74. Also shown in FIG. 10 are depth defining back surfaces, see at 80 and 82, which are contiguous to the horizontal ledges 76/78 formed into each main projecting portion 66/68 between their front and rear edges. As further shown, the back surfaces 80/82 converge with the upper most contoured portions (at 84/86) of each lateral projecting main portion 66/68.

As shown in the rotated front view of FIG. 13, the side projecting portions 66/68 provide, in combination with the upper recess contour 65 of the interior portion 70, lateral support to either side of the user's head and neck. As further depicted in each of FIGS. 14-15, both of which showing a partial cutaway of the environmental view of FIG. 13, each further better illustrates a clearance afforded by the ledge and interconnecting back surface and the ears, at 8, of the user's head 2.

FIG. 13 additionally depicts portions 73 and 75 of the sloping locations 72 and 74, these abutting the underside cheekbone areas corresponding to forward and just below the user's ears 8. In this fashion, the edge contours established between each of the uppermost portions 73/75 (of the sloping locations 72/74) and the horizontal ledges 76 and 78, provides additional and forward directed support to the user's head/neck/jaw and face while again providing an opening for the ears 8.

Figure 14:
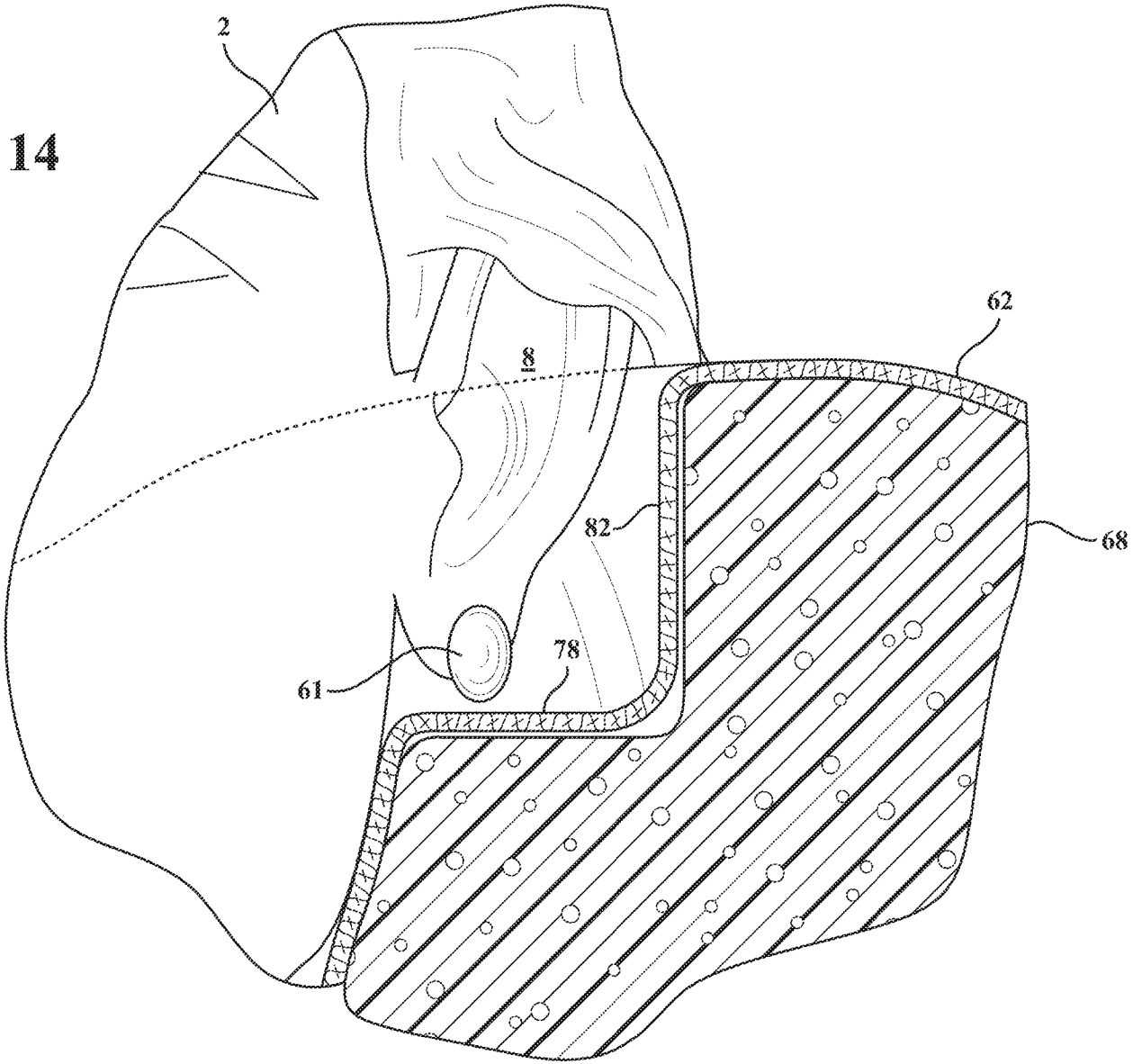
FIG. 14 is a partial cutaway of the environmental view of FIG. 13 and better showing the clearance afforded by the ledge and the user, such as shown wearing ear ornamentation/jewelry.
Figure 15:
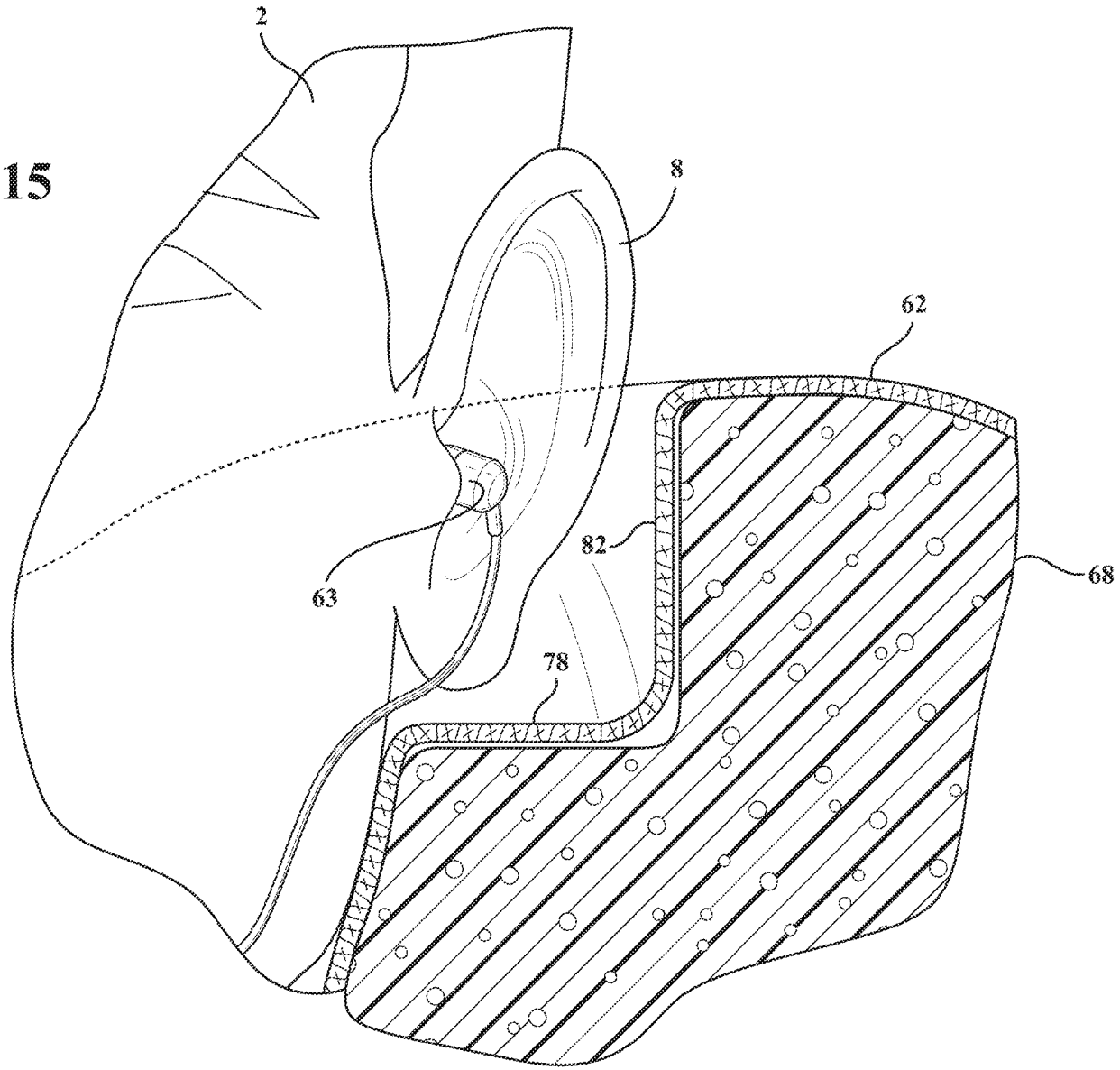
FIG. 15 is a similar view to FIG. 14 and depicting another user environment in which the individual is wearing in ear headphone buds.

In FIG. 14, such is shown with the user wearing ear ornamentation/jewelry 61 whereas, and in FIG. 15, a similar view to FIG. 14 depicts another user environment in which the individual is wearing in ear headphone buds 63. The advantage of the ledge configuration formed into each main lateral portion is to provide adequate clearance for the user's ears (as well as anything attached to or suspended from them), thereby also not impairing the user's ability to hear while resting (assuming such is further desired) and again with the side portions 66/68 providing the necessary lateral support.

The cushion 60 further includes a pair of secondary and downwardly projecting portions, these shown at 88 and 90, these generally aligning with the overall width of the central interior portion 70 of the cushion. As is further depicted in the rotated rear plan view of FIG. 11, the interior portion 70 is further shown to be modestly rearwardly spaced from the arcuate rear surfaces lateral projections 66/68, as further defined by a pair of spaced apart contour lines 92 and 94 as shown.

Figure 11:
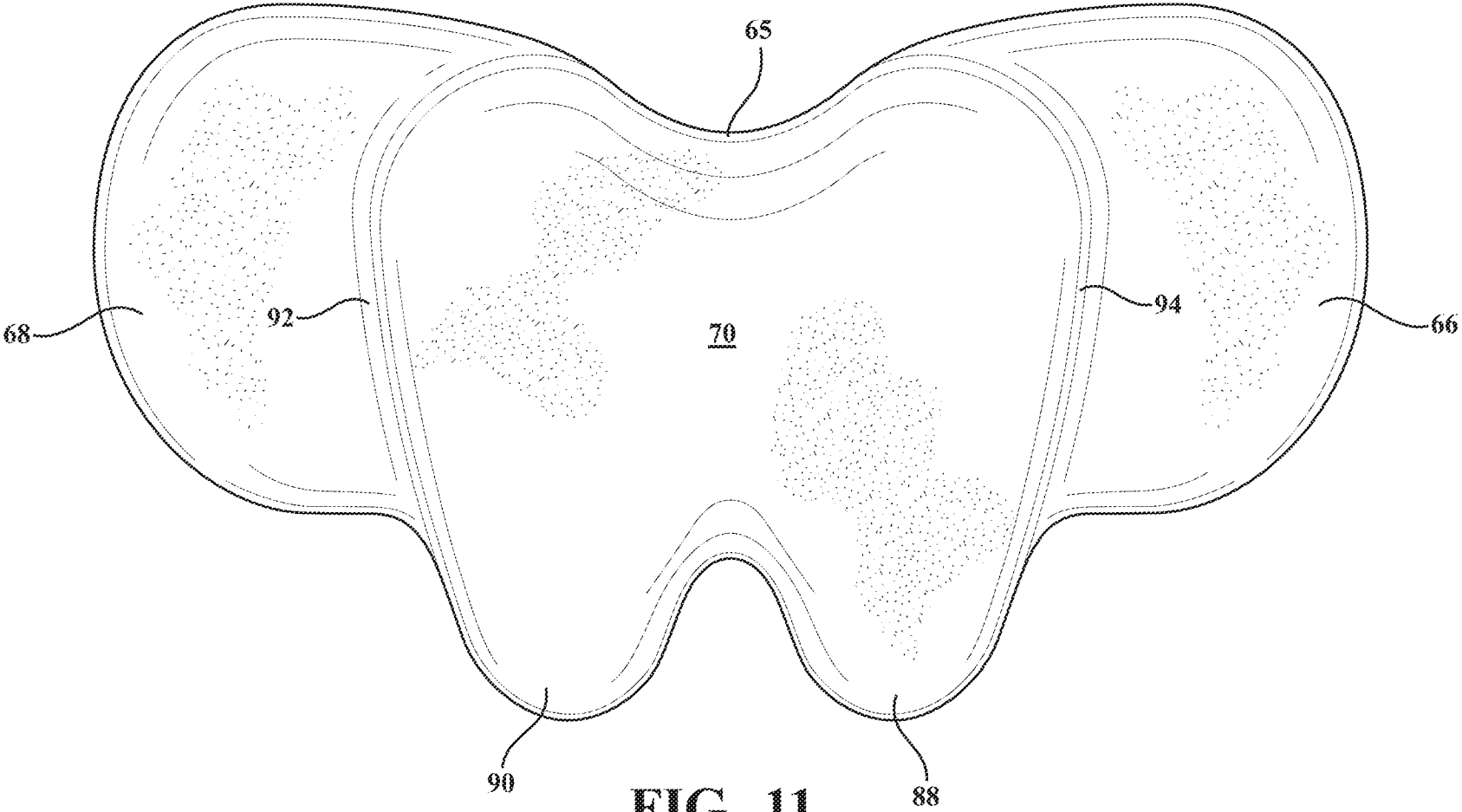
FIG. 11 is a rotated rear plan view of the cushion of FIG. 9.
Figure 16:
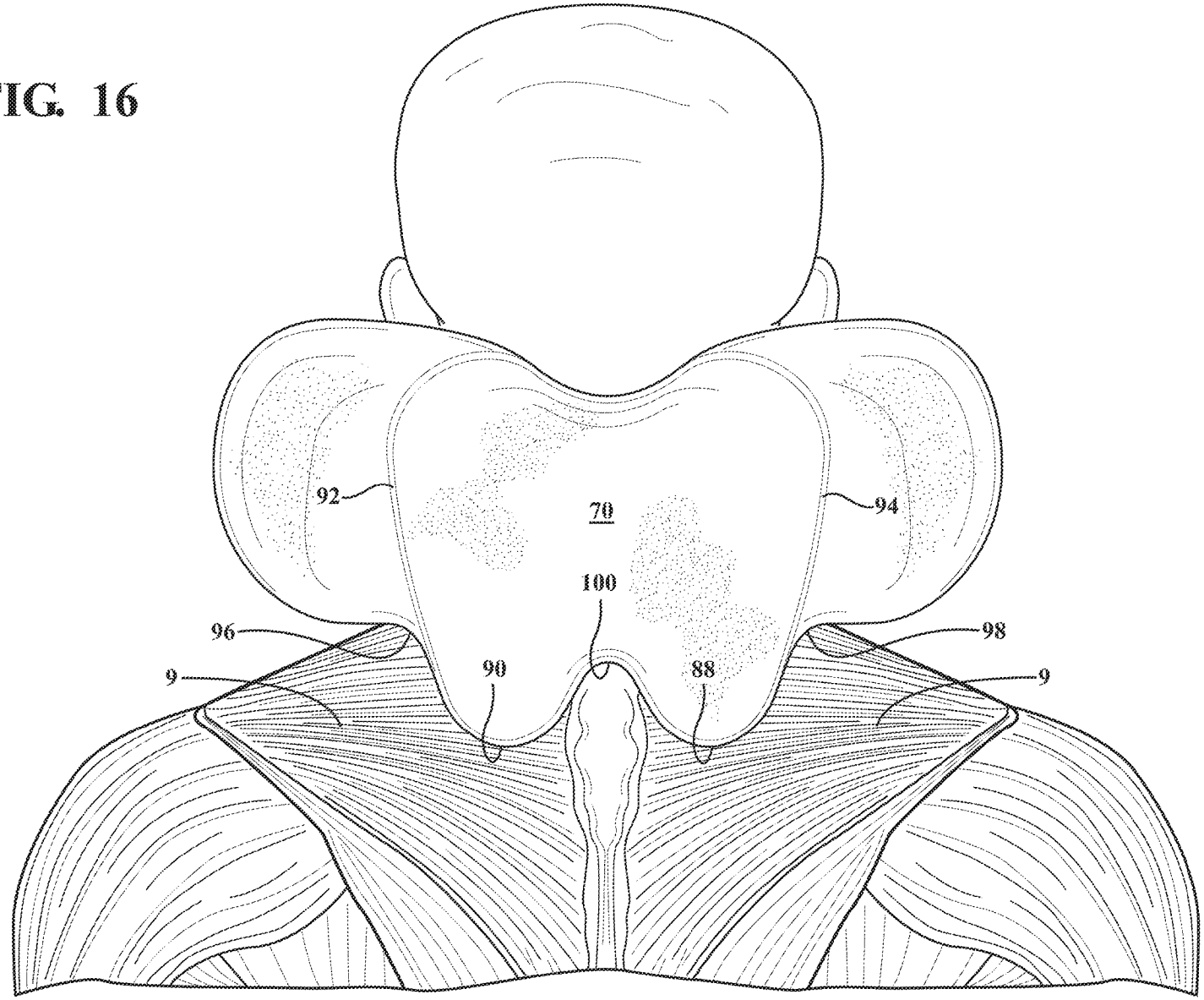
FIG. 16 is an enlarged view of the lower "W" shaping or profile provided by the cushion depicted in FIG. 12 and by which the downwardly projecting secondary portions provide pressure support to the wearer's trapezius (upper back) muscle group.

As further shown in FIG. 12, an environmental view is presented based on FIG. 11 and depicting the supporting aspects of the cushion including that provided by the downwardly directed and secondary pair of projections/portions 88/90. As further depicted in FIG. 16, an enlarged view of the lower "W" shaping or profile is provided by the cushion and as established between the downward projections. This includes alternating outer recessed bottom facing surfaces (at 96 and 98) positioned outside of the lower portions 88/90, along with an intermediate central recess positioned between the lower portions (further at 100), provide pressure support to the user's trapezius (upper back) muscle group.

FIG. 16 again best depicts the manner in which the downwardly projecting secondary portions provide pressure support to the wearer's trapezius (upper back) muscle group, these depicted at 9 aligning with either side of the user's shoulder area. As illustrated, the memory foam construction of the downward projecting portions 88/90 provides a degree of therapeutic and pressure point application to the trapezius muscle groups as part of the overall cushion support profile provided to the head, neck and shoulders of the upright seated individual.

Having described my invention, other and additional preferred embodiments will become apparent to those skilled in the art to which it pertains, and without deviating from the scope of the appended claims. This can include redesigning the cushion in further configurations to provide additional targeted therapeutic protection to given areas associated with the head, neck and shoulders, as well as modifying the material construction of the cushion in order to vary its elasticity and force application profiles.

I claim:

1. A contoured cushion, comprising:

a body constructed of memory foam material and configured with a plurality of three dimensional contoured surfaces adapted to conform to the shape of a user's head, neck, and upper shoulders for providing support to the user when supported in an upright seated position;

said contoured surfaces including each of a pair of main lateral projecting portions adapted for supporting the sides of the user's head and neck, an intermediate interior portion with a contoured recess upper surface extending between said lateral portions and further adapted for supporting the base of the user's head in communication with the neck, and a pair of secondary portions extending downwardly from said interior portion and adapted to support a trapezius shoulder muscles of the user; and said main lateral projecting portions each further including a horizontal ledge formed into a sloping surface, back surfaces formed contiguous with said ledges and extending upwardly to converge with upper most contoured portions of said main lateral projecting portions, said ledges and continuous back surfaces each defining, in combination, inner opposing recesses adapted to provide clearance for the user's ears.

2. The contoured cushion of claim 1, further comprising said clearance provided by said ledges and back surfaces permitting the user to wear any of earrings or in ear headphone earbuds.

3. The contoured cushion of claim 1, further comprising said pair of downward projecting secondary portions further comprising pressure generating portions which are adapted to provide treatment and massage relief to the trapezius muscles of the upright seated user.

4. The contoured cushion of claim 1, further comprising an outer covering having a zippered edge for receiving said body.

5. The contoured cushion of claim 1, further comprising said interior portion rearwardly spaced from arcuate rear surfaces of said main lateral projecting portions along a pair of spaced apart contours.

6. A contoured cushion, comprising:

a body constructed of memory foam material and configured with a plurality of three dimensional contoured surfaces adapted to conform to the shape of a user's head, neck, and upper shoulders for providing support to the user when supported in an upright seated position;

said contoured surfaces including each of a pair of main lateral projecting portions adapted for supporting the sides of the user's head and neck, an intermediate interior portion with a contoured recess upper surface extending between said lateral portions and further adapted to supporting the base of the user's head in communication with the neck, and a pair of secondary portions extending downwardly from said interior portion and adapted for supporting a trapezius shoulder muscles of the user; and said main lateral projecting portions each further including a horizontal ledge formed into a sloping surface, back surfaces formed contiguous with said ledges and extending upwardly to converge with upper most contoured portions of said main lateral projecting portions, said ledges and continuous back surfaces each defining, in combination, inner opposing recesses adapted to provide clearance for the user's ears.

7. A contoured cushion, comprising:

a body constructed of memory foam material and configured with a plurality of three dimensional contoured surfaces adapted to conform to the shape of a user's head, neck, and upper shoulders for providing support to the user when supported in an upright seated position;

said body further including a pair of main cushion portions each further having an inner opposing recess defined by a ledge which further adapts to provide clearance for the user's ears;

said contoured surfaces including each of a pair of main lateral projecting portions adapted for supporting the sides of the user's head and neck, an intermediate interior portion with a contoured recess upper surface extending between said lateral portions and further adapted to supporting the base of the user's head in communication with the neck; and said main projecting portions each further including a horizontal ledge formed into a sloping surface, back surfaces formed contiguous with said ledges and extending upwardly to converge with upper most contoured portions of said main lateral projecting portions, said ledges and continuous back surfaces each defining, in combination, inner opposing recesses adapted to provide clearance for the user's ears.

8. The contoured cushion of claim 7, further comprising a pair of secondary portions extending downwardly from said interior portion and adapted for supporting a trapezius shoulder muscles of the user.

9. The contoured cushion of claim 8, further comprising said pair of downward projecting secondary portions further comprising pressure generating portions which are adapted to provide treatment and massage relief to the trapezius muscles of the upright seated user.

10. The contoured cushion of claim 7, further comprising an outer covering having a zippered edge for receiving said body.

11. The contoured cushion of claim 7, further comprising said interior portion rearwardly spaced from an arcuate rear surfaces of said main lateral projecting portions along a pair of spaced apart contours.

* * * * *